US010053872B2

(12) United States Patent
Sighinolfi

(10) Patent No.: US 10,053,872 B2
(45) Date of Patent: Aug. 21, 2018

(54) LEVELING SPACER FOR THE LAYING OF SLAB PRODUCTS

(71) Applicant: RAIMONDI S.P.A., Modena (IT)

(72) Inventor: Riccardo Sighinolfi, Rubiera (IT)

(73) Assignee: RAIMONDI S.P.A., Modena (IT)

( * ) Notice: Subject to any disclaimer, the term of this patent is extended or adjusted under 35 U.S.C. 154(b) by 0 days.

(21) Appl. No.: 15/575,586

(22) PCT Filed: May 17, 2016

(86) PCT No.: PCT/IB2016/052858

§ 371 (c)(1),
(2) Date: Nov. 20, 2017

(87) PCT Pub. No.: WO2016/189423

PCT Pub. Date: Dec. 1, 2016

(65) Prior Publication Data

US 2018/0148939 A1 May 31, 2018

(30) Foreign Application Priority Data

May 22, 2015 (IT) ..... 102015000017009
May 22, 2015 (IT) ..... 102015000017031
May 22, 2015 (IT) ..... 102015000017036

(51) Int. Cl.
*E04F 21/20* (2006.01)
*E04F 21/00* (2006.01)

(52) U.S. Cl.
CPC ..... *E04F 21/20* (2013.01); *E04F 21/0092* (2013.01)

(58) Field of Classification Search
CPC ..... E04F 21/20; E04F 21/1877; E04F 15/02; E04F 21/22; E04F 21/0092; E04F 15/02452; E06B 1/6069
USPC ..... 52/126.1, 126.5, 126.7, 384–387, 389, 52/392
See application file for complete search history.

(56) References Cited

U.S. PATENT DOCUMENTS 4,397,125 A * 8/1983 Gussler, Jr. ..... E04F 21/0092 52/127.3
7,946,093 B1 * 5/2011 Sturino ..... E04F 21/0092 33/527
7,954,300 B1 * 6/2011 Kufner ..... E04F 21/22 33/526

(Continued)

*Primary Examiner* — Brian E Glessner
*Assistant Examiner* — Adam G Barlow
(74) *Attorney, Agent, or Firm* — Volpe and Koenig, P.C.

(57) ABSTRACT

A leveling spacer device, for laying slab-shaped products, includes: a base, positionable posteriorly of a laying surface of at least two slab-shaped products adjacent and flanked with respect to a flanking direction; a separator which rises from and is squared to the base, and is configured to contact, on opposite sides, lateral facing flanks of the two flanked slab-shaped products; a threaded shank which rises from the separator element with a screwing axis perpendicular to the base; a presser screwable to the threaded shank and a collar rotatably associated with respect to a rotation axis coinciding with the screwing axis, to an end of the presser facing towards the base, so that the collar is axially interposed between the end of the presser and the base. A constraint is defined between the collar and the presser, and is configured to axially constrain the collar and the presser.

9 Claims, 6 Drawing Sheets

(56) References Cited

U.S. PATENT DOCUMENTS 8,429,878 B1 * 4/2013 Hoffman ..... E04F 13/0889 52/747.11
8,429,879 B1 * 4/2013 Hoffman ..... E04F 21/0092 52/747.11
8,607,530 B2 * 12/2013 Hoffman ..... E04F 21/00 52/747.11
8,661,639 B2 * 3/2014 Bondielli ..... E04F 21/0092 29/243.5
8,966,835 B1 * 3/2015 Hoffman ..... E04F 21/0092 52/122.1
9,279,259 B1 * 3/2016 Russo ..... E04F 21/20
9,328,522 B2 * 5/2016 Bordin ..... E04F 21/20
2006/0185319 A1 * 8/2006 Kufner ..... E04F 13/0892 52/749.11
2010/0263304 A1 * 10/2010 Torrents I Comas ..... E04F 21/0092 52/126.5
2010/0287868 A1 * 11/2010 Kufner ..... E04F 21/0092 52/391
2013/0067854 A1 * 3/2013 Bordin ..... E04F 21/0092 52/749.11
2014/0033641 A1 * 2/2014 Trevisi ..... E04F 21/0092 52/749.1
2014/0298736 A1 * 10/2014 Bunch ..... E04F 21/0092 52/126.1
2014/0325936 A1 * 11/2014 PSaila ..... E04F 21/1877 52/749.11
2015/0184355 A1 * 7/2015 Wang ..... E02D 35/005 52/126.1
2015/0267420 A1 * 9/2015 Fontana ..... E04F 13/0892 52/126.1
2015/0354231 A1 * 12/2015 Bordin ..... E04F 21/20 52/126.6
2016/0369518 A1 * 12/2016 Sarajian ..... E04F 21/22
2017/0044779 A1 * 2/2017 Teng ..... E04F 21/1877
2018/0080237 A1 * 3/2018 Chen ..... E04F 21/20

* cited by examiner 60
61
62
621
620
612
611
622
63
610
602
600

E
601

504
512
511
51
502
50
500
501

602
610

C,D
503

10
20
30
40
50
60
A
P
41
42

LEVELING SPACER FOR THE LAYING OF SLAB PRODUCTS

TECHNICAL FIELD

The present invention relates to a leveling spacer device for laying slab-shaped products, such as tiles, natural stone slabs or the like, such as treadable surfaces, floorings, wall or ceiling claddings and the like.

BACKGROUND

In the sector of tile-laying for covering surfaces, such as floorings, walls and the like, the use of spacer devices is known which, as well as spacing the tiles, enable planar arrangement thereof, i.e. are such as to lay the in-view surface of the tiles substantially coplanar; these devices are commonly known as leveling spacer devices.

Spacer devices of known type generally comprise a base, positionable below the laying surface of at least two (three or four) adjacent tiles, from which emerges at least a separator element, able to contact, by action of the lateral flanks thereof, the facing flanks of the two (three or four) tiles to be arranged side-by-side on the laying surface, defining the breadth of the space interposed between the tiles.

The leveling spacer device is also provided with presser means cooperating with an emerging portion of the separator element which emerges above the plane defined by the in-view surface of the tiles. The presser means are essentially provided with a planar surface facing towards the base which is able to press the in-view surfaces of all the products supported by the base towards the base itself so as to level the in view surfaces.

Among the leveling spacer devices of known type there exist various types, of which one has the presser element shaped substantially as a wedge which runs on the in-view surface of the products, a further type of the leveling spacer devices is known as a screw leveling spacer device and includes the presser element being essentially constituted by a knob provided with a nut screw which can be screwed to a threaded shank (or the like) associated to the emerging portion of the separator element.

Once the presser element has been screwed on the threaded shank and has performed its task of leveling the tiles, and having waited for the adhesive on which the laying surfaces to solidify, it is sufficient to separate—for example thanks to lines of pre-weakened fractures appropriately realised between the separator element and the base—the separator element from the base, which base will remain invisibly incorporated in the adhesive below the laying surface of the tiles.

The screw leveling spacer devices, with respect to the wedge devices, have the drawback that the threaded knob remains engaged with the threaded shank following the separation of the separator element from the base and in order to re-utilise the presser element with a new separator element the operatives laying the tiles must proceed to unscrewing the threaded shanks from the relative threaded knobs with undoubted drawbacks in terms of time and costs for the operatives laying the tiles.

Further, with the aim of enabling a fine regulation of the pressure exerted by the knob on the in-view surface of the tiles, the pitch of the thread of the nut screw and the threaded shank must be sufficiently modest and the threaded shank sufficiently long.

This circumstance primarily involves the need to activate the screwing of the knob for a prolonged period of time and for a large number of revolutions from the moment of engaging the nut screw with the free end of the threaded shank up to reaching the point of contact between the knob and the laying surface of the tiles, especially if the tiles are of modest thickness.

Further, the same cost for the personnel is incurred when the knob is to be reset, as described above, for unscrewing the threaded shank from the knob, and the market offers use of an insert for electric screwdrivers suitable for gripping the stump of the threaded shank which projects from the knob with the intention of accelerating the unscrewing operations.

Further, the screw leveling spacer devices, with respect to the wedge spacers, can have the drawback that the torque force exerted by the knob on the threaded shank, especially in the final stages of blocking, can unload on the separator element which—being a slim sheet, the thickness of which must be as small as possible for containing the dimension of the gap between the tiles—is often subject to torque deformations which lead to an irregular localised widening of the gap between the tiles, in fact making the spacing function of the device ineffective.

Further, the screw leveling spacer devices can have the drawback that the rubbing exerted by the knob on the in-view surface of the tiles during the final tightening steps can unload in the form of a centrifugal force on the tiles which are, therefore, distanced irregularly at the device, widening or deforming the gap between the tiles, in fact making the spacing function of the device ineffective.

To obviate this drawback use of a collar is known, insertable on the threaded shank of the device during the laying (i.e. with the base already placed below the tiles) and resting on the in-view surface of the tiles, which collar can be interposed between the laying surface of the tiles and the knob, so that the knob drags, in the final blocking stages of the knob, on the collar and the collar remains solidly in contact with the in-view surface of the tiles.

The collar, however, involves a dead time for insertion on the leveling spacer devices and an added cost for the personnel involved in the laying, who sometimes do not use it for this reason.

An aim of the present invention is to obviate the above-mentioned drawbacks of the prior art, with a solution that is simple, rational and relatively inexpensive.

The aims are attained by the characteristics of the invention as reported in the independent claim. The dependent claims delineate preferred and/or particularly advantageous aspects of the invention.

SUMMARY

The invention in particular discloses a leveling spacer device for laying slab-shaped products for covering surfaces which comprises:

- a base, positionable posteriorly of a laying surface of at least two slab-shaped products adjacent and flanked with respect to a flanking direction;
- a separator element which rises from the base and is squared to the base, and is able to contact, on opposite sides, lateral facing flanks of the two flanked slab-shaped products;
- a threaded shank which rises from the separator element with a screwing axis thereof perpendicular to the base;
- a presser element screwable to the threaded shank by means of a nut screw, wherein the nut screw is defined by separate and elastically yielding portions of a helix, which portions are able to engage the threaded shank in a pawl coupling following a set reciprocal axial translation between the threaded shank and the presser element, for example (exclusively) in the nearing direction between the presser element and the base.

With this solution the threaded shank can rapidly be inserted and de-inserted from the nut screw, with a reduction of device manoeuvring times and costs for the personnel tasked with laying the slab-shaped products.

In an aspect of the invention the nut screw can be constituted by a single turn of the helix.

With this solution the design of the device is particularly simple and easy to make, for example by plastic material moulding, and is equally effective in operation.

In an aspect of the invention, the presser element can advantageously comprise a tubular body provided with a through-cavity in a parallel direction to the screwing axis; each portion is associated to an elastically-flexible tab projectingly branching from the tubular bar, wherein each portion defines the end of the tab that is proximal to the central axis of the tubular body.

With this solution, the portions are elastically yielding in the radial direction, for example following a singly-directed axial soliciting, in a controlled way.

In a further aspect of the invention, the device can comprise a collar coaxially rotatably associated to an end of the presser element facing towards the base.

With this solution, the screwing rotation of the presser element is not unloaded onto the products to be laid with a consequently greater precision in the separation of the products themselves, which are therefore separated by regular and precise gaps.

The collar can advantageously comprise a planar surface perpendicular to the screwing axis, interposed axially between the end of the presser element and the base and facing towards the base at which a slit is defined, configured so as to be passed through by the separator element.

In a further aspect of the invention, a sliding connection can be defined between the slit and the separator element, in particular the separator element and the slit can be configured so as to realise the sliding connection (anti-rotational axial sliding).

With this solution, the collar enables maintaining the separator element solidly stable, which will not be deformed by the torque induced, especially in the final steps of tightening of the threaded connection between the nut screw of the presser element and the male thread of the pin.

In a further aspect of the invention the slit can be elongate with a longitudinal axis that is radial with respect to a rotation axis of the collar.

The slit can advantageously comprise a central portion coaxial with the nut screw of the presser element and broadened, the threaded shank being insertable, with radial play, internally of the central portion of the slit.

With this solution, the threaded shank can easily be inserted and centred in the nut screw of the presser element.

In a further aspect of the invention the collar can comprise two of the slits, squared to one another and, for example, joined at the respective central portion.

With this solution it is possible to facilitate the inserting of the separator element internally of the slit and, further, include the use of different types of separator element, for example cross- or T-shaped.

In a further aspect of the invention, the collar can comprise at least an orientating marker projecting externally of the collar in a direction that is aligned or squared to each slit.

With this solution, even without having direct visual access to the slit, the presser element and the relative collar can be arranged immediately, intuitively and rapidly, so as to be able to be axially inserted on the separator element during laying, i.e. it is sufficient to orientate the orientating marker along an edge of the product to be laid so as to have—with the planar surface of the collar facing towards the tiles—the slit arranged parallel to and aligned with the separator element which is to be inserted.

In a further aspect of the invention, a constraint is defined between the collar and the presser element, which constraint is able to axially constrain the collar and the presser element.

With this solution the collar can be fixed to the presser element before being inserted on the threaded shank and the separator element, with a reduction of costs for the personnel tasked with laying the slab-shaped products.

In an advantageous aspect of the invention, the constraint can comprise an annular step coaxially associated to one from between the presser element and the collar and a plurality of engaging teeth projecting axially from the other of the collar and the presser element and aligned along an imaginary circumference that is coaxial with respect thereto.

With this solution, the engagement, for example removable or semi-permanent, of the collar to the presser element is made particularly simple, effective and rapid.

In an aspect of the invention, the threaded shank comprises a distal end from the separator element, provided with a gripping element configured so as to be axially inserted between the portions of the nut screw.

With this solution, it is possible and easy to de-insert the threaded shank from its engagement with the nut screw, for example at the end of the laying operations, when the presser element and the collar element are to be re-utilised.

In a preferably simple, economical and intuitive way, the gripping element comprises a plate lying on a radial plane of the threaded shank and extending radially beyond the external diameter of the male thread of the threaded shank.

In a further aspect of the invention the male thread of the threaded shank can be of the sawtooth type.

With this solution, the reciprocal translation between the threaded shank and the nut screw can have a preferential sliding direction and the other direction can, for example, be inhibited.

A further aspect of the invention discloses a leveling spacer device for laying slab-shaped products for covering surfaces, also protectable independently of what has been detailed in the foregoing, which comprises:

- a base, positionable posteriorly of a laying surface of at least two slab-shaped products adjacent and flanked with respect to a flanking direction;
- a separator element which rises from the base and is squared to the base, and is able to contact, on opposite sides, lateral facing flanks of the two flanked slab-shaped products;
- a threaded shank which rises from the separator element with a screwing axis thereof perpendicular to the base;
- a presser element screwable to the threaded shank and
- a collar rotatably associated with respect to a rotation axis coinciding with the screwing axis, to an end of the presser element facing towards the base, so that the collar is axially interposed between the end of the presser element and the base, wherein the collar comprises a slit configured so as to be passed through by the separator element and to determine therewith a sliding connection.

For example the separator element and the slit can be configured so as to realise the sliding connection (anti-rotational axial sliding).

With this solution, the collar enables maintaining the separator element solidly stable, which will not be deformed by the torque induced, especially in the final steps of tightening of the threaded connection between the nut screw of the presser element and the male thread of the pin.

In an aspect of the invention, the collar comprises a planar surface perpendicular to the rotation axis, and facing towards the base at which a slit is defined.

With this solution, the collar defines the leveling element for the laying surfaces of the slab-shaped products.

In a further aspect of the invention, the slit can advantageously comprise a central portion that is broadened and coaxial with the rotation axis of the collar, the threaded shank being insertable, with radial play, internally of the central portion of the slit.

With this solution, the threaded shank can easily be inserted and centred in the nut screw of the presser element.

In a further aspect of the invention the slit can be elongate with a longitudinal axis that is radial with respect to a rotation axis of the collar (and centred with respect thereto). For example, the slit can advantageously comprise two lateral flanks that are substantially straight and parallel, between which the separator element van be substantially snugly housed with only a small amount of lateral and axial play. In practice the slit has a shape that for over a half of its overall length is substantially complementarily shaped to the separator element.

In a still further aspect of the invention the collar can comprise two of the slits, squared to one another and, for example, joined at the respective central portion.

With this solution it is possible to facilitate the inserting of the separator element internally of the slit and, further, include the use of different types of separator element, for example cross- or T-shaped.

In a further aspect of the invention, the collar can comprise at least an orientating marker projecting externally of the collar in a direction that is aligned or squared to each slit.

With this solution, even without having direct visual access to the slit, the presser element and the relative collar can be arranged immediately, intuitively and rapidly, so as to be able to be axially inserted on the separator element during laying, i.e. it is sufficient to orientate the orientating marker along an edge of the product to be laid so as to have—with the planar surface of the collar facing towards the tiles—the slit arranged parallel to and aligned with the separator element which is to be inserted.

In a further aspect of the invention, a constraint can be defined between the collar and the presser element, which constraint is able to axially constrain the collar and the presser element.

With this solution the collar can be fixed to the presser element before being inserted on the threaded shank and the separator element, with a reduction of costs for the personnel tasked with laying the slab-shaped products.

In an advantageous aspect of the invention, the constraint can comprise a snap-fit configured to axially removably constrain the collar and the presser element, leaving free reciprocal rotation there-between with respect to the rotation axis.

In an advantageous aspect of the invention, the constraint can preferably comprise an annular step coaxially associated to one from between the presser element and the collar and a plurality of engaging teeth projecting axially from the other of the collar and the presser element and aligned along an imaginary circumference that is coaxial with respect thereto.

With this solution, the engagement, for example removable or semi-permanent, of the collar to the presser element is made particularly simple, effective and rapid.

A still further aspect of the invention discloses a leveling spacer device for laying slab-shaped products for covering surfaces, also protectable independently from what has been detailed in the foregoing, which comprises:

- a base, positionable posteriorly of a laying surface of at least two slab-shaped products adjacent and flanked with respect to a flanking direction;
- a separator element which rises from the base and is squared to the base, and is able to contact, on opposite sides, lateral facing flanks of the two flanked slab-shaped products;
- a threaded shank which rises from the separator element with a screwing axis thereof perpendicular to the base;
- a presser element screwable to the threaded shank and
- a collar rotatably associated with respect to a rotation axis coinciding with the screwing axis, to an end of the presser element facing towards the base, so that the collar is axially interposed between the end of the presser element and the base, wherein a constraint is defined between the collar and the presser element able to axially constrain the rotatable collar and the presser element.

With this solution the collar can be fixed to the presser element before being inserted on the threaded shank and the separator element, with a reduction of costs for the personnel tasked with laying the slab-shaped products.

In an advantageous aspect of the invention, the constraint can comprise snap-fit configured to axially removably constrain the collar and the presser element, leaving free reciprocal rotation there-between with respect to the rotation axis.

With this solution the engagement between the collar and the presser element is particularly effective, rapid and, further, is accompanied by a distinctive noise that indicates it has been correctly positioned.

In a further aspect of the invention, the constraint can comprise an annular step coaxially associated to one from between the presser element and the collar and a plurality of engaging teeth projecting axially from the other from between the collar and the presser element and aligned along an imaginary circumference that is coaxial with respect thereto.

With this solution, the engagement, for example removable or semi-permanent, of the collar to the presser element is made particularly simple, effective and rapid.

The collar can advantageously comprise a planar surface perpendicular to the rotation axis of the collar, interposed axially between the end of the presser element and the base and facing towards the base.

With this solution, the collar defines the leveling element for the laying surfaces of the slab-shaped products.

The collar can advantageously comprise a slit, passing at the planar surface, configured so as to be passed through by the separator element and to determine there-with a sliding connection. For example the separator element and the slit can be configured so as to realise the sliding connection (anti-rotational axial sliding).

With this solution, the collar enables maintaining the separator element solidly stable, which will not be deformed by the torque induced, especially in the final steps of tightening of the threaded connection between the nut screw of the presser element and the male thread of the pin.

In a still further aspect of the invention, the slit can advantageously comprise a central portion that is broadened and coaxial with the rotation axis of the collar, the threaded shank being insertable, with radial play, internally of the central portion of the slit.

With this solution, the threaded shank can easily be inserted and centred in the nut screw of the presser element.

In a further aspect of the invention the slit can be elongate with a longitudinal axis that is radial with respect to a rotation axis of the collar (and centred with respect thereto).

In a still further aspect of the invention the collar can comprise two of the slits, squared to one another and, for example, joined at the respective common central portion.

With this solution it is possible to facilitate the inserting of the separator element internally of the slit and, further, include the use of different types of separator element, for example cross- or T-shaped.

In a further aspect of the invention, the collar can comprise at least an orientating marker projecting externally of the collar in a direction that is aligned or squared to each slit.

With this solution, even without having direct visual access to the slit, the presser element and the relative collar can be arranged immediately, intuitively and rapidly, so as to be able to be axially inserted on the separator element during laying, i.e. it is sufficient to orientate the orientating marker along an edge of the product to be laid so as to have—with the planar surface of the collar facing towards the tiles—the slit arranged parallel to and aligned with the separator element which is to be inserted.

BRIEF DESCRIPTION OF THE DRAWINGS

Further characteristics and advantages of the invention will emerge from a reading of the following description, provided by way of non-limiting example with the aid of the figures illustrated in the appended tables of drawings.

DETAILED DESCRIPTION OF THE PREFERRED EMBODIMENTS

Figure 3:
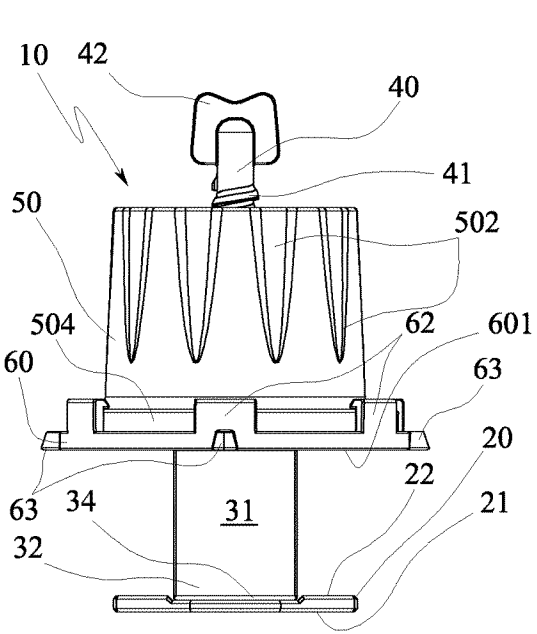
FIG. 3 is a side elevation of FIG. 1.
Figure 2:
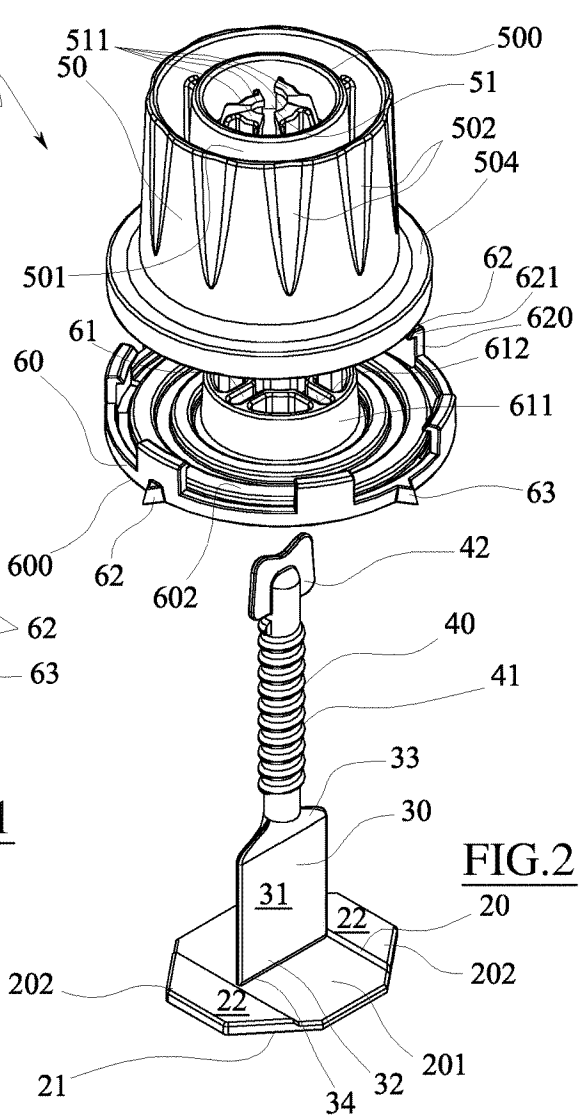
FIG. 2 is an exploded axonometric view of FIG. 1.
Figure 1:
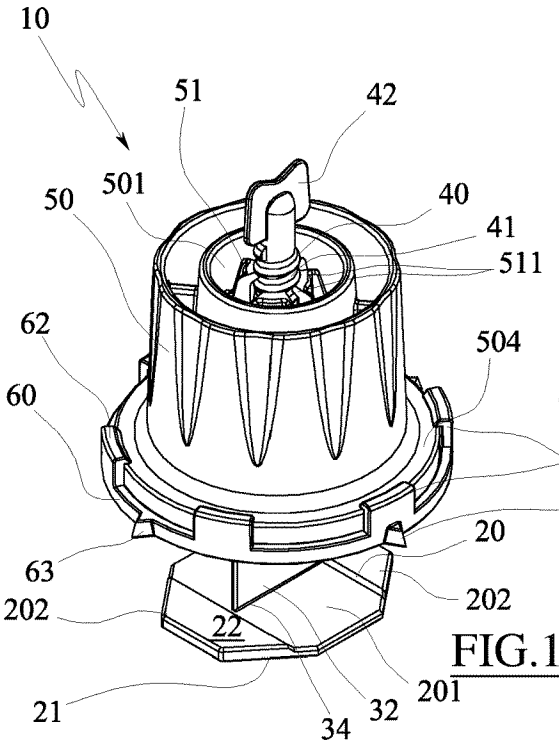
FIG. 1 is an axonometric view of a leveling spacer device with the presser element screwed on the threaded shank.
Figure 4:
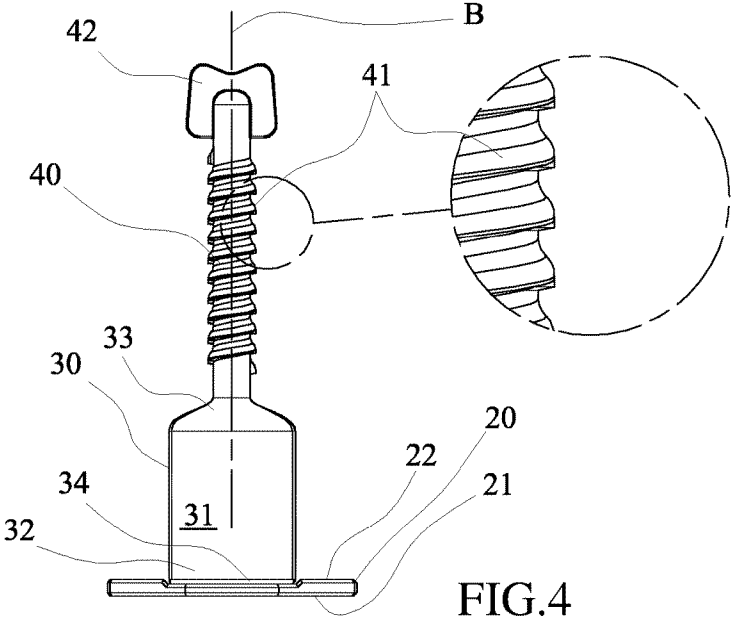
FIG. 4 is a side elevation of the base, the separator element and the threaded shank of the leveling spacer device of the invention.
Figure 6:
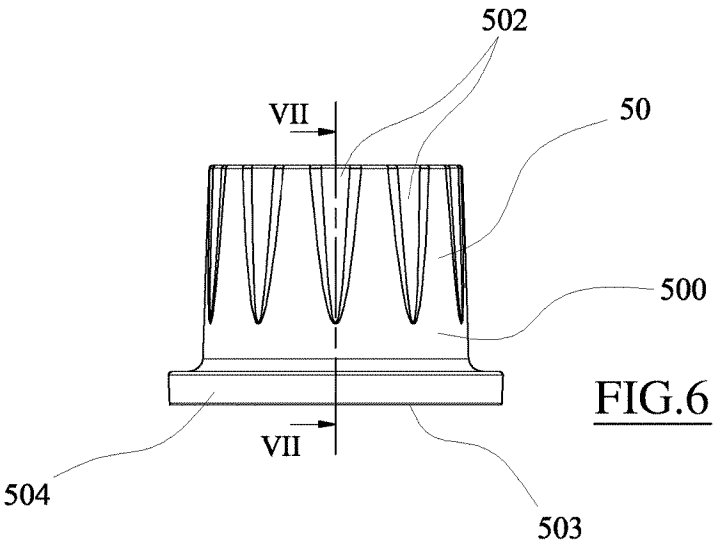
FIG. 6 is a side elevation of the presser element of the leveling spacer device of the invention.

With particular reference to the figures, reference numeral 10 denotes in its entirety a leveling spacer device able to facilitate laying of slab-shaped products, such as tiles or the like, denoted in their entirety by letter P and able to clad surfaces, i.e. floorings, walls, ceilings and the like.

The device 10 comprises a base 20 which is able in use to be located posteriorly of the laying surface of the tiles P (shown only schematically in FIGS. 12*a*-12*d*).

In the illustrated example the base 20 has a broadened shape, for example polygonal, circular or irregular, defining a lower surface 21, for example flat, able to be arranged distanced from the laying surface of the tiles P and an opposite upper surface 22, for example flat, able to be arranged proximally to the laying surface of the tiles P and, for example, in contact therewith. The upper surface 22 of the base 20 is in practice destined to restingly receive a portion of the laying surface of one or more tiles P.

The base 20 can be immersed in a layer of adhesive arranged on an underlying surface which is destined to be clad by the tiles P, with the lower surface 21 facing towards the underlying surface and the upper surface 22 facing towards the overlying tiles P.

In some laying situations it is possible for the base 20 to be arranged resting on a flat fixing surface, such as a floor joist or the like, and fixed thereto.

In practice, the base 20 is positioned below at least two (or more) adjacent tiles as will more fully emerge in the following.

The base 20 in the illustrated example is defined by a monolithic body, for example made of a plastic material, which has a shape (in plan view) that is substantially polygonal.

In the example the base 20 has an (irregular) octagonal shape, for example symmetrical with respect to a central longitudinal axis.

The base 20 has a symmetrical shape with respect to a central plane perpendicular to the base, for example with respect to a plane passing through the longitudinal axis thereof.

In the illustrated example the base 20 comprises a central zone 201 exhibiting a different thickness with respect to two opposite lateral zones 202 (spaced along the parallel direction to the longitudinal axis of the central zone of the central zone 201).

The lateral zones 202 have, in the example, a greater thickness with respect to the central zone 201, and the upper surface 22 of the base 20 is defined by the upper face of the lateral zones.

In practice, the central zone 201 defines an empty volume fillable, in use, by the adhesive for treatment of the laying surface of the tiles P.

The base 20 can have, for example, at least a lateral border (not illustrated) inclined by an acute angle with respect to the lower surface 21, and two lateral inclined edges can preferably be defined opposite and for example symmetrical with respect to the central plane of symmetry of the base.

Each lateral border defines an inclined salient ramp which connects the lower surface 21 to the upper surface 22 of the base 20.

In practice, each inclined lateral border facilitates the laying operative's laying of the tiles P in inserting the base 20 below the laying surface P of the tiles P when they are already resting on the adhesive layer.

For the same purposes, and for the further purpose of moving the least quantity of adhesive while the base 20 inserts below the laying surface of the tiles P, the base 20 can be constituted by a longitudinal strip from which spread, on opposite sides, a plurality of coplanar beams to the strip (and for example parallel and spaced from one another).

The device 10 further comprises a separator element 30 which emerges squared to the base 20, for example coplanar with the central axis (of symmetry) thereof, which is able, in use, to contact at least a portion of the flanks facing at least two (or more) tiles P to be flanked in use along a flanking direction denoted in the figures by the letter A.

The separator element 30 is a parallelepiped plate-shaped body, for example, having a rectangular base (very narrow and long) which defines a slim (and wide) partition wall which subdivides the upper surface 22 of the base 20 into two opposite portions (equal and symmetrical with respect to the separator element in the example).

The separator element 30 therefore comprises at least two planar and parallel opposite face (31), a reciprocal distance whereof defines the thickness of the separator element 30 and, therefore, the width of the gap between the tiles P separated thereby.

In practice, each tile P which rests on one of the two portions of the upper surface 22 of the base 20 is able to contact one of the faces 31 of the separator element 30.

It is possible for the separator element 30 also to have a corner spacer arranged squared with respect to the faces 31 of the separator element.

Figures 5A, 5B, 5C:
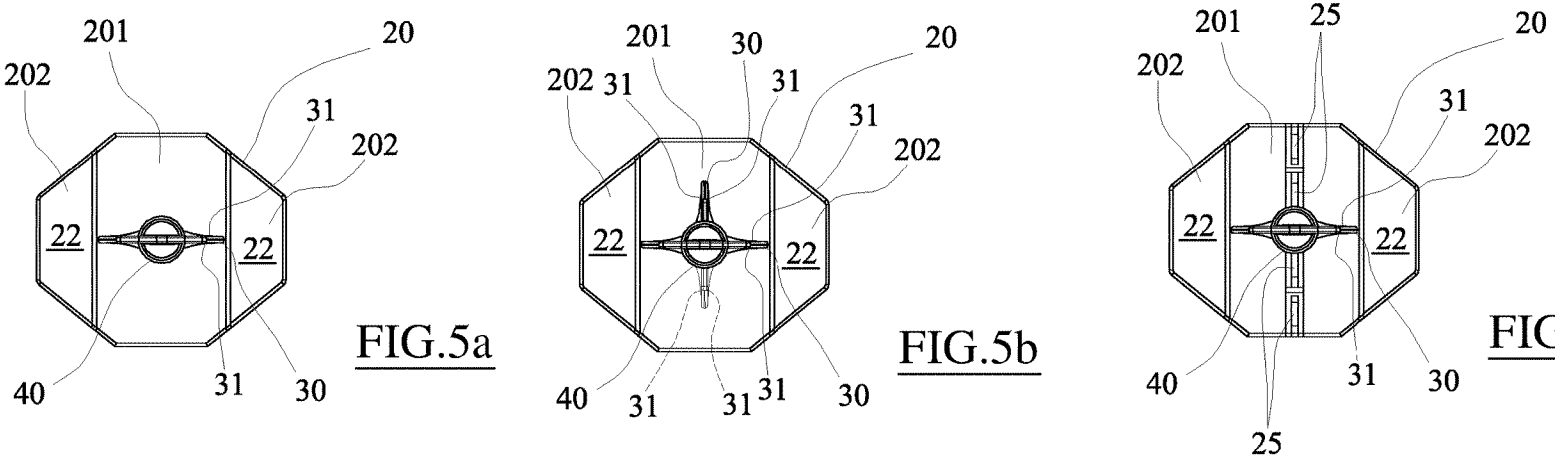
FIG. 5*a* is a plan view from above of FIG. 4.
FIG. 5*b* is a plan view from above of a possible alternative embodiment of the separator element of the leveling spacer device of the invention.
FIG. 5*c* is a plan view from above of a possible alternative embodiment of the separator element of the base of the leveling spacer device of the invention.
Figures 7, 8, 9, 10, 11:
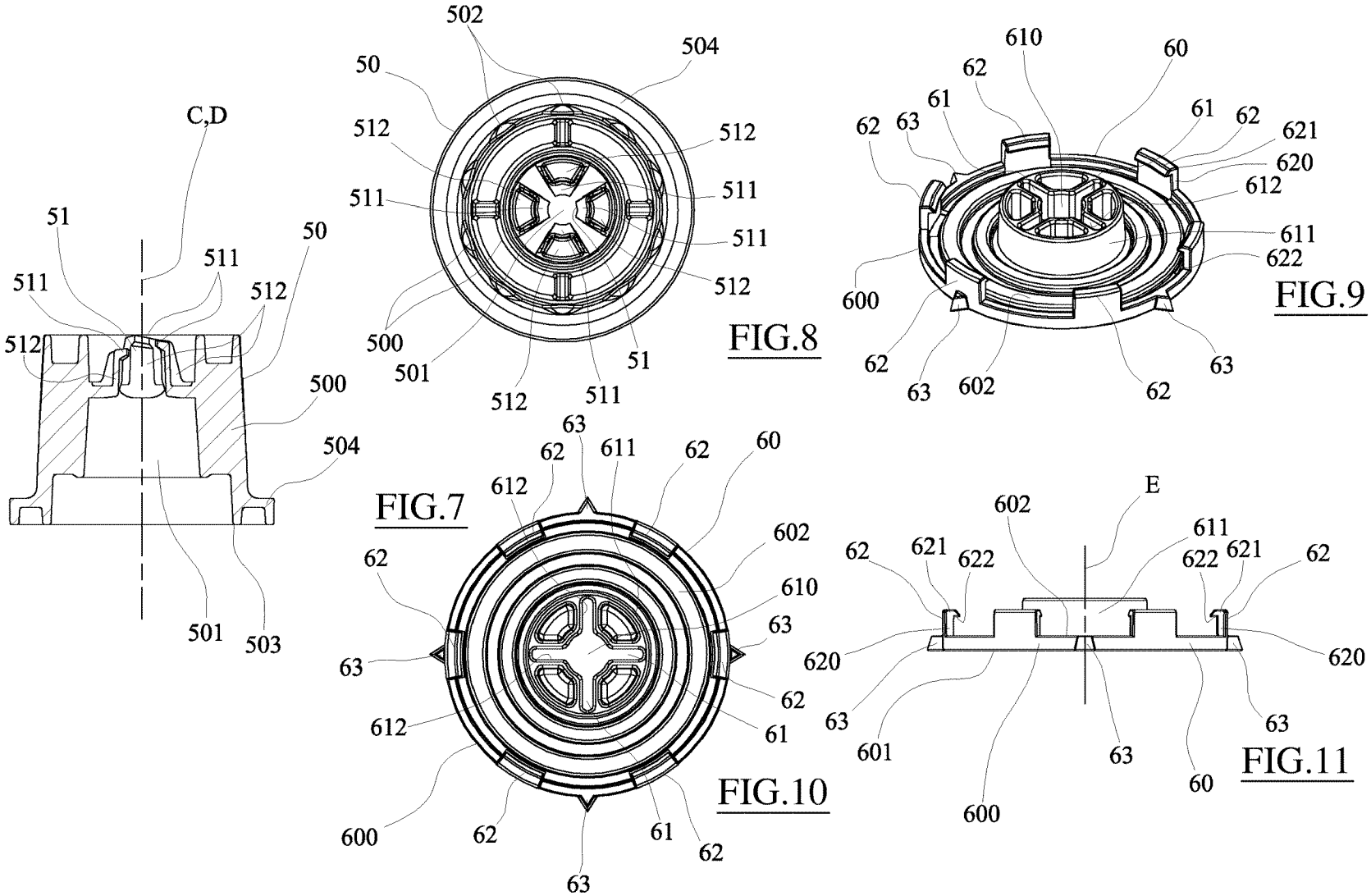
FIG. 7 is a section view along line VII-VII of FIG. 6.
FIG. 8 is a plan view from above of FIG. 6.
FIG. 9 is an axonometric view of a rotating collar of the leveling spacer device of the invention.
FIG. 10 is a plan view from above of FIG. 9.
FIG. 11 is a side elevation of FIG. 9.

For example, the corner spacer can be defined in a single piece with the separator element 30 (for example by interposing an easy-break line so as to be able to remove the corner spacer when required) which in the example can have a substantially cross- or T-shaped section (for example with a slim wall), as shown in an alternative embodiment illustrated in FIG. 5*b*, so as to subdivide the upper surface 22 of the base 20, respectively, into four or three opposite portions, on which four or three tiles P are positionable.

Further, the separator element 30 has a height (being a long dimension along a perpendicular direction to the base 20) that is larger than the thickness of the tiles P to be laid, so that the top of the separator element 30, once the tiles P are resting on the upper surface 22 of the base 20, projects superiorly (abundantly) with respect to the plane to be levelled defined by the in-view surface of the tiles P.

The separator element 30 has a lower end 32 that is preferably joined to the base 20 and an opposite free end 33 that is distal from the base 20.

The free end 33 can have for example upper walls sloping from the centre towards the opposite longitudinal ends.

For example, the separator element 30 is made in a single body with the base 20.

Further, the separator element 30 has a pre-weakened easy-break line or section 34 able in use to be arranged inferiorly of the in-view surface level of the tiles P to be spaced and levelled, for example substantially at the same level as the upper wall 22 of the base 20 (or a little lower than it).

For example, the easy-break line or section 34 is made on the separator element 30 in proximity of the base 20, for example below the level defined by the upper surface 22.

It is possible for the easy-break line or section 34 to be made at the join line between the base 20 and the separator element 30 or, alternatively, the easy-break line or base 34 can be made at the position of the separator element 30 in proximity of the base 20.

In practice, the separator element 30, i.e. the lower end 32 thereof or a lower portion thereof proximal to the lower end thereof 32, is joined to the base 20 by means of the easy-break line or section 34, which for example defines a break line that is substantially parallel to the upper surface 22 of the base 20.

The easy-break line or section 34 can be constituted by a tapered section (V-shaped) of the transversal section (perpendicular to the faces 31) of the separator element 30 or by a series of through-openings (having a circular or semi-circular shape), for example aligned, made in the separator element 30 (for example at or in proximity of the lower end thereof 32).

Owing to this easy-break line or section 34 the whole emerging portion of the device 10, comprising the separator element 30, can be easily removed once the tiles P have been laid and the adhesive supporting them has been consolidated, while the portion immersed in the adhesive, i.e. the base 20, remains trapped (and cannot be recovered) in the adhesive below the laying surface of the levelled tiles P.

In a further alternative embodiment shown in FIG. 5*c*, the base 20 of the device 10 can advantageously comprise (apart from what is described in the foregoing in which the separator element 30 is not provided with the corner spacer shown in FIG. 5*b*) at least a corner spacer which emerges from the base 20 squared with respect to the separator element 30.

In practice, the separator element 30 and the corner spacer, in a plan view, are arranged in cross-fashion.

The corner spacer has opposite lateral flanks, perpendicular to the faces 31 of the separator element 30 which are singly able to come into contact with the facing perpendicular flanks of the tiles P, for alignment thereof along a perpendicular direction to the flanking direction A.

The corner spacer is advantageously but not limitedly mobile between a raised position, in which it projects superiorly of the base 20, being raised therefrom, and a non-interfering position with the perpendicular flanks of the tiles P (with respect to the perpendicular direction to the flanking direction A).

In practice, the corner spacer can be configured so that in the non-interfering configuration thereof it lowers so that the vertical volume thereof is contained totally or at least partially within the vertical volume (thickness) of the base 20.

In the example, the corner spacer comprises at least a block 25 having two lateral flanks, which when the block 25 is in the raised position are able to come into contact with the flanks of two tiles P to be flanked along the perpendicular direction to the flanking direction A.

In the preferred embodiment shown in the figures, the block 25 is associated to the base 20 in such a way that in the non-interfering position the lateral flanks are all contained within the vertical volume of the base 20, i.e. the block 25 is sunk in the base 20, and in the raised position they emerge superiorly of the base so that they can function as abutting elements for the flanks of the tiles P to be arranged squared.

The thickness in plan view of the corner spacer (i.e. the distance between the lateral flanks thereof) is advantageously substantially equal to the thicknesses (i.e. the distance between the faces 31) in plan view of the separator element 30, so that the tiles P are distanced both along the flanking direction A and along the perpendicular direction, by a same distance.

It is however possible for the thickness in plan view of the corner spacer 50 to be different from the thickness in plan view of the separator element 30 as a function of the various laying requirements of the tiles P.

In the illustrated example, the device 10 comprises at least two corner spacers, as described in the foregoing and independent of one another, which are arranged on an opposite side with respect to the separator element 30; in particular, in the illustrated example two pairs of corner spacers are present, each couple being arranged on an opposite side with respect to the separator element 30.

The lateral flanks of each corner spacer are two-by-two substantially coplanar with one another and perpendicular to the faces 31 of the separator element 30, so as to guarantee the effective alignment of the flanks of the tiles P along the perpendicular direction to the flanking direction A.

It is possible for the device 10 to alternatively comprise a single corner spacer which crosses the separator element 30 (for example through an appropriate central window).

Each block 25 can be realised in at least a plastically or elastically yielding material and branches projectingly from the base 20. In practice, each block 25 has a free end and an opposite end fixed to the base 20 and is realised in a single piece with the base.

Owing to the yielding nature of the material the block 25 is made of, the block 25 is bent upwards by an acute angle in the raised position, while it is arranged substantially coplanar with the base 20 in the non-interfering or lowered position.

The corner spacers can also be different from those shown in the figures, for example they can be telescopic, removable or the like, such as the ones described in European patent application no. EP 2 565 346 in the name of the present applicant.

Figure 13A:
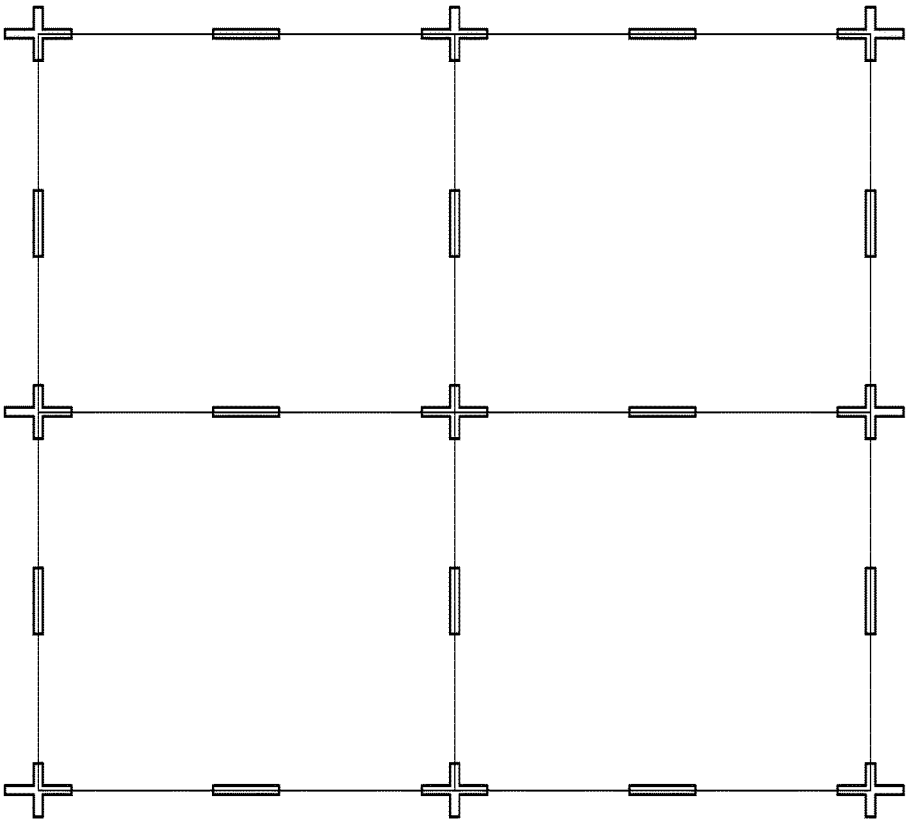
FIG. 13*a* is a schematic plan view of a first "straight lay" possible laying plan of slab-shaped products.
Figure 13B:
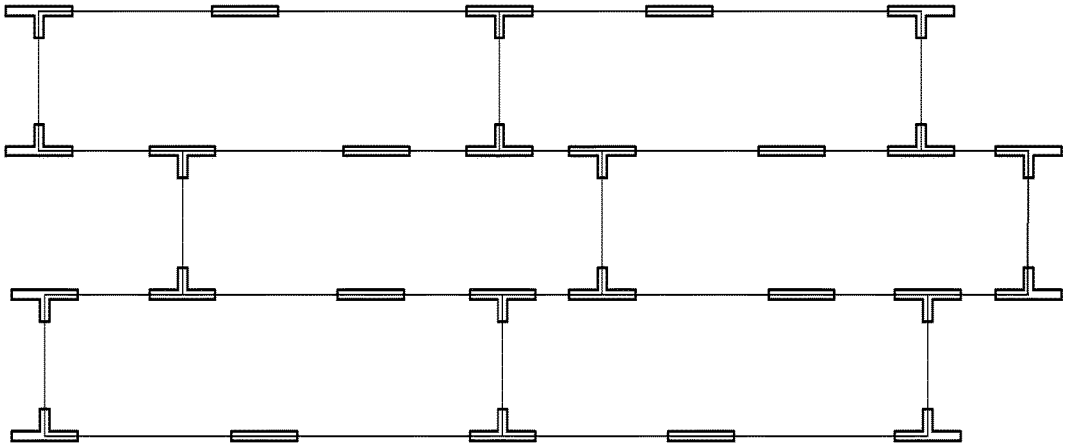
FIG. 13*b* is a schematic plan view of a second "staggered" possible laying plan of slab-shaped products.
Figure 13C:
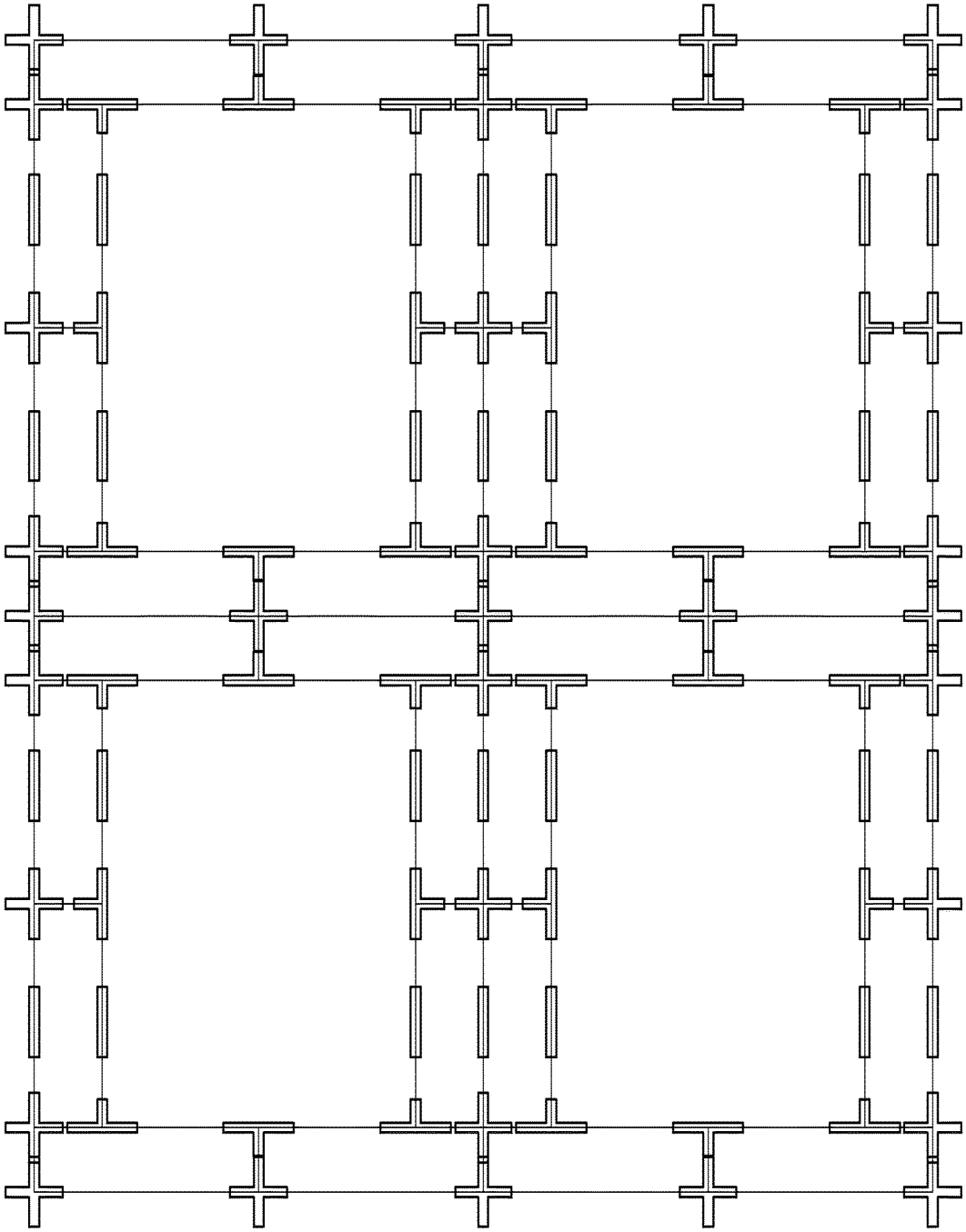
FIG. 13*c* is a schematic plan view of a second "complex" possible laying plan of slab-shaped products.

In practice, owing to the presence of the corner spacers of the base (FIG. 5*c*) or the separator element 30 (FIG. 5*b*), by using a single device 10 it is possible to make more than one arrangement of the tiles P, for example by means of a plan conformation of the corner spacers and the separator element 30, substantially in a cross-shape, a T-shape and/or a straight shape, and therefore the device 10 can be used in various zones of the tile P, as is more clearly visible in FIGS. 13*a*, 13*b* and 13*c* in which three different possible known laying layouts of tiles P are illustrated.

Alternatively, the corner spacers can be rigidly fixed to the base 20 and/or the spacer element.

The device 10 further comprises a threaded shank 40, for example provided with a male thread 41, which emerges perpendicularly to the base 20, preferably from the free end 33 of the separator element 30, axially prolonging the separator element 30.

In practice, the screwing axis, denoted by letter B in the figures, is perpendicular to the upper surface 22 of the base 20.

The male thread 41 has for example a sawtooth shape, i.e. it has an asymmetric thread, in which the flank facing the free end (upper) of the threaded shank 40 has a profile angle having a greater inclination with respect to the profile angle defined by the flank facing towards the end (lower) fixed to the separator element 30 (or facing towards the base 20).

In the example, the flank of the male thread 41 facing towards the end (lower) fixed to the separator element 30 is substantially perpendicular to the screwing axis B.

The threaded shank 40 can further comprise, at the free end thereof (i.e. distal from the separator element 30), a gripping element, which in the example comprises a plate 42, preferably slim, which lies on a radial plane of the threaded shank 40 and which extends radially for a greater length than the external diameter of the male thread 41 of the threaded shank, but smaller than or equal to the width of the separator element 30, with which it is for example coplanar.

For example the plate 42 has an ergonomic shape able to be easily gripped or stably manoeuvred by the laying operative using two fingers.

The threaded shank 40 in the example has a length that is substantially double the height of the separator element 30.

The male thread 41 preferably has a constant pitch (for example 2-4 mm, preferably 3 mm) and, for example, extends for (almost) all the length of the threaded shank 41 (with the exception of the end zone thereof occupied by the plate 42).

The device 10 further comprises a presser element 50 which can be screwed on the threaded shank 40.

The presser element 50 comprises a tubular body 500 provided with a through-cavity 501 (and cylindrical) with a central (and longitudinal) axis C that is preferably straight.

The through-cavity 501 has for example an internal diameter that is greater than the external diameter of the male thread 41 of the threaded shank 40, so the threaded shank 40 can insert axially with abundant radial play internally of the through-cavity 501 of the tubular body 500.

The through-cavity 501, for example, has an internal diameter (i.e. the minimum diameter) that is substantially equal to or a little greater than the width of the separator element 30 (in the parallel direction to the faces 31 thereof and to the base 20).

In practice, the separator element 30 can axially cross—from side to side—the through-cavity 501 of the presser element 50.

In practice, the through-cavity 501 has no partitions or walls that prevent the passage or axial sliding of the separator element 30, for example once separated from the base 20, along the through-cavity 501.

In the example the tubular body 500 comprises (or is constituted by) an internal tubular body defining the internal cavity 501 and an external tubular body, splined with play, for example, coaxially, on the internal tubular body and joined thereto (solidly constrained) by joint bridges, for example radial.

The external mantle of the tubular body 500, for example of the external tubular body, comprises recesses 502 and/or reliefs, for example having an axial extension, for facilitating the grip and the activation in rotation (with respect to the central axis C) of the tubular body.

The tubular body 500 in the example is substantially cylindrical in shape with an axis coinciding with the central axis C of the through-cavity 501, and it is possible for the tubular body 500 to have any other shape, such a for example a cap, conical, butterfly, handle or another suitable shape able to be gripped by a laying operative's hand in order for it to be screwed.

The tubular body 500 has a planar end 503 that can be faced towards the base 20 (parallel thereto) when the presser element 50 is screwed onto the threaded shank 40 and perpendicular to the central axis C of the through-cavity 501.

The through-cavity 501, at the planar end 503, defines an introduction mouth by which the free end of the threaded shank 40 (and of the separator element 30) can be (axially) introduced.

The through-cavity 501, at the end opposite the planar end 503, defines an exit mouth by which the free end of the threaded shank 40 (and of the separator element 30) can be (axially) removed, as will more fully be described in the following.

In practice, the front wall of the tubular body 500 that defines the planar end 503, for example of the external tubular body, is able to faced in use towards the base 20 (or toward the tiles P so as to go into contact therewith) and defines an annular surface that is perfectly planar and perpendicular to the central axis C of the through-cavity 501.

The tubular body 500 comprises, for example at or in proximity of the planar end 503, and annular step 504 projecting radially towards the outside of the tubular body 500, for example the external tubular body.

The annular step 504, for example, has a substantially circular shape and is coaxial to the through-cavity 501.

The annular step 504 defines, in effect, a lower annular surface concentric with the planar end 503 and for example coplanar therewith, and an opposite upper annular surface, for example also planar and parallel to the planar end 503.

The presser element 50 comprises a nut screw 51 associated internally of the internal cavity 501, which is configured for coupling with the male thread 41 of the threaded shank 40.

The nut screw 51 has a screwing axis D that coincides with the central axis C of the through-cavity 501.

The nut screw 51 is for example made at the end of the tubular body 500 (or in proximity of it, i.e. at a few mm from it or for example beyond a half of the length of the tubular body 500 in the direction of the central axis C) opposite the planar end 503.

The nut screw 51 is, advantageously, defined by portions 511 separate from one another (and interrupted) by a helix, for example a single turn of a helix.

In practice, the portions 511, separated from one another by interspaces (empty), are aligned along a helical trajectory, for example constituted by a single turn.

In practice, the portions 511 are located at different heights (progressively rising along a helical trajectory in an anti-clockwise direction) with respect to the plane defined by the planar end 503.

In the example, the nut screw 51 is constituted by four portions 511, for example equidistant and having an identical longitudinal extension along the helix; in practice the interspaces between the portions 511 define a cross centred in the screwing axis D and are joined to one another by a central hole having an internal diameter substantially equal to the internal diameter of the male thread 41 of the threaded shank 40.

In practice, the portions 511 have crests able to be coupled with the bottoms of the male thread 41 of the threaded shank 40 for the screwing and unscrewing of the presser element 50 on the threaded shank with a consequent translation along the screwing axis B, D following a reciprocal rotation imparted with respect to the screwing axis B, D.

The portions 511 are advantageously elastically yieldable in a radial direction (for example being substantially mobile in a radial direction) so as to be able to engage the threaded shank 40 in a pawl coupling following a set reciprocal axial translation. i.e. along the screwing axis B, D, between the threaded shank 40 and the presser element 50.

For example, the connection between the portions 511 and the male thread 41 of the threaded shank 40 is such as to enable sliding, in a pawl coupling, of the presser element 50 along the screwing axis B of the threaded shank 40 (or of the threaded shank 40 along the screwing axis D of the nut screw 51) in a single sliding direction, substantially preventing the reciprocal sliding in the opposite direction.

The pawl coupling of the portions 511 is defined by a reciprocal distancing of the portions 511 (in the radial direction) caused by the thrust exerted by the crests of the male thread 41 of the threaded shank 40 following an axial thrust thereon (directed in a same direction as the sliding direction imposed by the screwing of the nut screw 51 on the male thread 41) in contrast with an elastic pushing force (reaction and directed radially) exerted by the portions themselves (i.e. the tabs 512).

During the pawl coupling of the portions 511 on the threaded shank 40, the nut screw 51 forcedly opens and closes elastically each time the helix of the male thread 41 passes, while the tubular body 500 remains undeformed and slides along the longitudinal axis (i.e. the screwing axis D) of the threaded shank 40.

In the example this solution is attained due to the sawtooth profile of the above-described male thread 41, though it is possible however to realise the thread by an appropriately equivalent profile of the portions 511 (i.e. the crests thereof).

Each portion 511, in the example, is associated to an elastically-flexible tab 512 projecting from the tubular body 500, i.e. internally of the internal tubular body, internally of the through-cavity 501.

The tubular body 500 (internal and/or external) is substantially non-deformable (for example it does not have elastically yielding portions from externally thereof), the only yielding portions (elastically or resiliently) associated to the tubular body are the portions 511 and/or the tabs 512 which constitute the nut screw 51.

Each portion 511 defines a free end of the tab 512 proximal to the central axis C, i.e. to the screwing axis D of the tubular body 500.

The tab 512 has a longitudinal axis that is substantially inclined relative to the central axis C of the through-cavity 501, for example such as to enable a radial flexion when solicited by an axial thrust.

The tab 512 advantageously has an end constrained to the internal wall of the tubular body 500 (internal), i.e. to the wall delimiting the through-cavity 501, located at a distance from the planar end 503 of the tubular body 500 that is smaller than the distance of the free end of the tab (which defines one of the portions 511) from the planar end 503.

In practice, the tab 512 is inclined by a positive acute angle with respect to a plane that is perpendicular to the screwing axis D passing through the constrained end of the tab 512.

This configuration of the tab 512 contributes to facilitating the radial deformation of the tab 512 following an axial thrust thereon preferentially in a direction, i.e. in the direction of a thrust directed axially from the planar end 503 towards the opposite end of the tubular body 500, discouraging (when not actually being substantially non-deformable) deformation due to an axial thrust facing from the opposite side.

The tab 512 can have a width and/or a thickness that decreases from the constrained end towards the free end (upper).

The surface of the tab 512 facing towards the planar end 503 of the tubular body 500 (or in any case towards the introduction of the threaded shank 40) can have a convex profile (with a convexity facing towards the planar end 503), so as to define an entry surface for the threaded shank 40 towards the nut screw 51.

Further, the convex profile can define an entry surface for the plate 42 of the threaded shank 40 too, which is therefore drawn to insert in one of the free interspaces defined between the portions 511 (for example in two opposite interspaces), centering the threaded shank 40 in the presser element 50, i.e. arranging the screwing axis B of the threaded shank 40 coinciding with the screwing axis D of the nut screw 51.

The tab 512 and/or each portion 511 can, as in the example, be made in a single body with the tubular body 500, for example the internal tubular body, which in turn can be made in a single body with the external tubular body or be separated therefrom and fixed by means of appropriate fastenings.

It is however also possible to realise each tab 512 and/or each portion 511 in a separate body and appropriately fixed by means of appropriate fastenings to the tubular body 500.

Further, the portions 511 can be made (in a single body or separate) of a more rigid material with respect to that the tubular body 500 is made of, for example the external one or the tabs 512.

At least two interspaces are defined between two tabs 512 (and portions 511), which interspaces are aligned in a radial direction (i.e. which define a virtual diameter of the tubular body 500). The interspaces have a width that is substantially equal to or larger than the thickness of the separator element 30 (i.e. the distance between the faces 31 thereof). In the example four tabs 512 define four interspaces, aligned two-by-two (in a cross-fashion).

In this way, as will more fully be described in the following, the separator element 30 (for example when separated from the base 20) can axially cross the through-cavity 501 of the tubular body 50, passing between (the portions 511 and) the tabs 512, i.e. crossing the interspaces defined there-between.

In practice, while the threaded shank 40 pawl-couples with the nut screw 51 (for example when the separator element 30 is separated from the base 20) in the allowed sliding direction, i.e. the sliding direction (or screwing direction) of the presser element 30 from the free end of the threaded shank 40 to the lower end 32 of the separator element 30, the separator element 30 can slide from the planar end 503 of the presser element 50, to the opposite end of the tubular body 500, passing through the interspaces defined between the portions 511 of the nut screw 51 (and the tabs 512) so as to exit (and be freed from the engagement with the presser element 50) from the end of the tubular body 500 opposite the planar end 503.

The device 10 can further comprise a collar 60, which is rotatably associated to the presser element 50, for example relative to a rotation axis E coinciding with the screwing axis D of the nut screw 51 of the presser element.

The collar 60 can be associated to the planar end 503 of the presser element 50, i.e. to the end thereof facing towards the base 20, so as to be interposed between the base 20 and the planar end 503 (and, in use, between the in-view surface of the tiles P and the planar end 503) when the presser element 50 is screwed on the threaded shank 40.

In practice, the collar 60 comprises an annular body 600 that comprises a planar surface 601 that is lower than and perpendicular to the rotation axis E and an opposite surface 602, for example also planar and perpendicular to the rotation axis E.

For example the surfaces 601, 602 are substantially annular and circular.

The planar surface 601, in use, is able to go into contact with the laying surface of the tiles P while remaining substantially solidly constrained thereto (stationary) during the screwing-in rotation of the presser element 50 onto the threaded shank 40.

The opposite surface 602, in use, is able to go into dragging contact (along a circular dragging trajectory) with the planar surface 503 surface during the screwing-in rotation of the presser element 50 onto the threaded shank 40.

Annular recesses can be included in the planar surface 601 (for example coaxial with the planar surface itself) and, for example, in the opposite surface 602 annular reliefs can be defined (for example axially corresponding to the above-mentioned annular recesses), which can be coupled in complementary recesses realised in the planar end 503, for example between the annular step 504 and the planar end of the tubular body 500 (external).

The collar 60 comprises a slit 61 (a through-slit in an axial direction), which crosses the disc-shaped body 600 and is open at the planar surface 601 and at the opposite surface 602.

The slit 61 for example is elongate with a longitudinal axis that is radial with respect to a rotation axis E of the collar 60 and preferably crosses the centre of the collar 60 (coinciding with the rotation axis).

In practice the slit 61 is centred on the rotation axis E of the collar 60.

In the example, the slit 61 is narrow and log, with a length a little greater than the width of the separator element 30 and with a width a little larger (for example less than twice) than the thickness of the separator element 30.

The slit 61 is, therefore, configured so as to be crossed (with play) by the separator element 30 and to determine there-with a sliding connection.

In practice, the separator element 30 can be inserted axially internally of the slit 61 and, once the separator element 30 is engaged internally of the slit 61, reciprocal rotation is prevented (except for tiny oscillations use due to the tolerances in play and the necessary play that enables easy insertion of the separator element 30 in the slit 61) between the collar 60 and the separator element.

For example, the slit 61 can advantageously comprise two lateral flanks that are substantially straight and parallel, between which the separator element 30 is snugly accommodated (with a small amount of laterally play).

The lateral flanks of the slit 61 each define an elongate surface (in a radial direction) on which a long strip of the face 31 of the separator element 30 rests (from the periphery towards the centre) when it is inserted in the slit, especially if subjected to torque (in this case the opposite faces 31 of the separator element 30 would be in contact with the opposing lateral flanks of the slit 61, along a pair of the strips, in fact preventing the torque deformation of the separator element 30).

The slit 61 comprises a central portion 610 (a through-opening) coaxial with the collar, in which at least the threaded shank 40 is insertable with radial play.

In practice the central portion 610 is substantially circular with an internal diameter that is (slightly) bigger than the external diameter of the male thread 41 of the threaded shank 40; in this way the threaded shank 40 can be inserted, with radial play, in the central portion 610, which has the double function of enabling axial passage of the threaded shank, so that the slit 61 can be inserted by the separator element 30, and of coaxially centring the threaded shank 40 with respect to the collar 60 and therefore with respect to the presser element 50 and the nut screw 51, enabling engagement.

For the insertion of the threaded shank 40 internally of the central portion 610, the plate 42 is inserted in the slit 61, thus centring the threaded shank 40 in the central portion 610, i.e. arranging the screwing axis B of the threaded shank 40 coinciding with the screwing axis D of the nut screw 51 of the presser element 50.

The edges of the slit 61 (and of the central portion 610 thereof) facing towards the planar surface 601 can be rounded, so as to overall define an entry surface for the separator element 30 (i.e. the free end 33 thereof, which is also sloped) in the slit 61.

In the example, the slit 61 (and the central portion 610 thereof) is made at a shank 611, for example cylindrical or in any case profiled, rising axially from the opposite surface 602 (and coaxial with the collar 60); in this way the slit 61 has an axial thickness (or height), for example of about 1 cm (or in any case greater than the thickness of the wall of the collar 60) so as to define high internal walls 612 (perpendicular to the planar surface 601) able to define a large zone of contact with the faces 31 of the separator element 30.

The collar 60 preferably comprises two of the slits 61, as described above, squared to one another and joined at the respective central portion 610.

In this way the insertion of the separator element 30 in one of the slits 61 is made simpler and, further, use of the collar 60 is allowed including in a case in which the separator element 30 is configured like the one illustrated in the embodiment of FIG. 5*b*.

A constraint is preferably defined between the collar 60 and the presser element 50, which is able to constrain the collar 60 and the presser element 50 axially, enabling reciprocal rotation with respect to the rotation axis E (coinciding with the screwing axis D when the collar 60 is constrained to the presser element 50).

The constraint is for example a snap-fit configured so as to axially removably or semi-permanently constrain the collar 60 and the presser element 50, leaving, as mentioned in the foregoing, free reciprocal rotation there-between with respect to the reciprocal rotation axis.

In the example, the collar 60 comprises a plurality of engaging teeth 62 projecting, for example in an axial direction from the side opposite the planar surface 601 and aligned along an imaginary circumference that is coaxial relative to the collar 60 and, for example, having a diameter that is substantially greater than the external diameter of the annular step 504 of the presser element 50.

Each engaging tooth 62 has a leg 620 rising from the collar 60, an end of which branches, for example, in a single body therewith, from a peripheral portion of the collar and the opposite free end of which comprises an engaging head 621 conformed substantially as a grapple towards the rotation axis E of the collar 60 and defining an engaging surface 622, substantially planar, facing towards the opposite surface 602 of the collar.

The engagement surface 622 is at a distance from the opposite surface 602 of the collar 60 by a height that is substantially equal to or a little greater than the height of the annular step 504.

The engagement tooth 62, for example the leg 620 thereof, is elastically yielding, preferably in a radial direction, in such a way as to engage in a pawl coupling to the presser element 50, i.e. the annular step 504 thereof.

The engagement head 621 further defines a surface opposite the engagement surface which can be inclined with respect to the planar surface 602 by an acute entry angle, so as to impart a radial thrust (towards the outside of the collar 60) to the engaging tooth 620 following an axial compression thrust on the engagement head 621 of the engagement tooth.

In practice, the snap fit between the presser element 50 and the collar 60 is defined by the engagement between the engaging teeth 62 and the annular step 504. By opening out radially, the engaging teeth 62, following a reciprocal axial nearing translation between the presser element 50 and the collar 60, enable entry of the annular step 504 between the engaging teeth, in practice bringing the planar end 503 of the presser element 50 into contact (circumferential dragging contact) with the opposite surface 602 of the collar 60, and the engaging surface 622 of the contacting engaging teeth 62 (circumferential dragging) with the opposite upper annular surface of the annular step 504.

The legs 620 of the engaging teeth 620 can overall define a cylindrical surface (in portions) coaxial with the collar 60 and within which the perimeter edge of the annular step 504 rotates.

It is possible for the constraint reciprocally constraining the collar 60 and the presser element 50 in an axial direction, leaving reciprocal rotation free, to be different from those illustrated, for example of a friction type, or another suitable connection, either semi-permanent or removable or, at most, permanent according to constructional needs.

The collar can comprise at least an orientating marker 63 projecting externally of the collar 60, for example externally of the peripheral portion of the collar, in a direction that is aligned or squared to each slit 61.

In the example, two orientating markers 63 are included for each slit 61, arranged on opposite sides (radially aligned or squared therewith) of the slit.

In the light of the foregoing, the functioning of the device 10 is as follows.

To clad a surface with a plurality of tiles P it is sufficient to lay them on a layer of adhesive and thereafter lay the tiles P.

In practice, in the location the first tile P is to be arranged in it is sufficient to position a first device 10, the base 20 of which is destined, for example, to be placed below two edges of respective tiles P, an edge and two corners of three respective tiles P or four edges of respective four tiles P, according to the desired laying layout.

Once the base 20 has been positioned, it is sufficient to position the tiles P in such a way that a portion of the lateral flank is in contact respectively with one of the faces 31 of the separator element 30 (and/or with a lateral flank of a pair of blocks 25 in the case illustrated in FIG. 5*b*).

In this way the squared arranged and the same distance between the tiles P which surround the device 10 is guaranteed. When for example the tiles P have particularly large dimensions, it is possible to position a device 10 at a median zone of the lateral flank of the tile.

It is possible, for example, to work by first laying a tile P and then, at the edge or a flank thereof, inserting a base 20 portion of the device 10 below the tile.

Once the various bases 20 have been positioned with the respective separator elements 30 (and possibly the corner elements) as described in the foregoing, while the adhesive is still not entirely consolidated the threaded shank 40 is inserted in the presser element 50, which by pressing on the in-view surface of the tiles P locally at the various points thereof (median or at the corners) enables perfect leveling of the in-view surfaces of the tiles with which the device 10 is used.

Figures 12A, 12B, 12C, 12D, 12E, 12F:
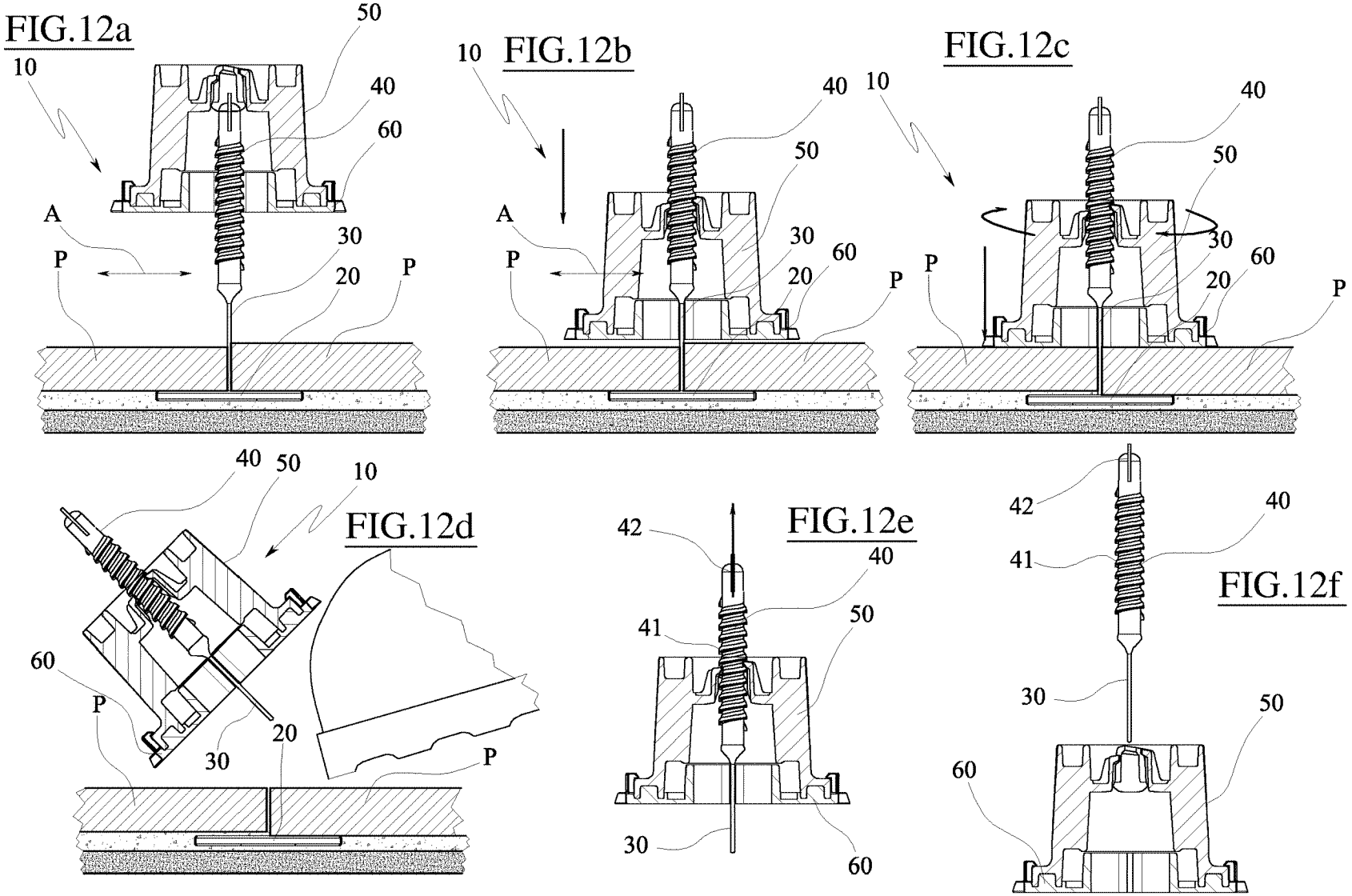
FIGS. 12*a*-12*f* represent a functioning sequence of the leveling spacer device of the invention.

In practice, for example, after having used the constraint to join the collar 60 and the presser element 50, it is sufficient to axially insert the free end of the threaded shank 40 internally of the central portion 610 of the slit 61 and, from there, into the through-cavity 501 of the presser element 501, as shown in FIG. 12*a*, up until the male thread 41 enmeshes with the nut screw 51.

Thereafter, with the aim of rapidly nearing the planar surface 601 of the collar 60 to the in-view surface of the tiles P, it is sufficient to exert an axial thrust on the presser element 50 facing the tiles P (i.e. along a same sliding direction as the screwing direction i.e. the nearing direction of the presser element 50 to the base 20), in this way the nut screw 51 is forced, i.e. the portions 511 making up the nut screw 51, to pawl-couple with the male thread 41 of the threaded shank 40 for an axial travel which is interrupted (as visible in FIG. 12*b*) when the planar surface 601 of the collar 60 reaches the in-view surface of one or more of the tiles P axially superposed thereon.

During the axial run of the presser element 50 along the threaded shank 40 (both by sliding and during the eventual screwing of the presser element 50 on the threaded shank 40), the separator element 30 is afforded entry to the slit or slits 61.

At this point, by activating the presser element 50 in rotation, the laying operative screws thereon the threaded shank 40 so as to exert a gradual pressure, appropriately calibrated and controllable, on the in-view surface of all the tiles P on which the planar surface 601 of the collar 60 rest (see FIG. 12*c*) or on the planar end 503 of the presser element 50.

During this screwing rotation, the collar 60 (where included) remains solid in rotation with the threaded shank 40 and the separator element 30 (i.e. the tiles P) while sliding axially.

In practice the slit 61 of the collar 60 enables the presser element 30 to be made sturdier against any eventual torque deformation imparted by the engagement, especially up to the end of the tightening, of the nut screw 51 on the threaded shank 40; further, the planar surface 601 remains (stationary) in contact with the in-view surface of the tiles P, in this way preventing any deformation of the arrangement thereof or any undesired dragging on the in-view surface thereof.

The planar end 503 of the presser element 50, on the other hand, drags on the opposite surface 602 of the collar 60 or on the in-view surface of the tiles P.

Lastly, when the adhesive has hardened and is gripping on the laying surface of the tiles P, the separator element 30 element is broken, for example with a smart kick (as illustrated in FIG. 12*d*) along the easy-break line or section 34, thus removing the separator element 30, with the presser element 50 screwed to the threaded shank 40, in order to proceed to grout the gaps between the tiles P without the base 20 being visible on the finished surface.

In order to be able to re-utilise the presser elements 50, with the relative collars 60, it is sufficient to remove the threaded shank 40 from engagement with the nut screw 51.

For example, and rapidly as shown in FIGS. 12*e* and 12*f*, the threaded shank 40 can be pulled axially in the distancing direction from the planar surface 601 (or from the planar end 503), for example by gripping the plate 42.

In practice it is possible to de-insert the threaded shank 40 and the separator element 30 fixed thereto by translating them in the enabled sliding direction (i.e. the same direction as the translation direction imposed by the screwing of the presser element 50 on the threaded shank 40).

In this way the portions 511 pawl-couple the male thread 41 of the threaded shank 40 which can therefore easily de-insert from the presser element 50 (and from the collar 60).

In practice, by pulling the threaded shank 40 from the free end thereof distancingly from the presser element 50 it is de-inserted from the presser element.

While the threaded shank 40 pawl-couples the portions 511 of the nut screw 51, the separator element 30 slides along the through-cavity 501 of the presser element 50.

Once the male thread 41 of the threaded shank 40 is released from engagement with the portions 511 of the nut screw 51, i.e. it is de-inserted by its proximal end and constrained to the separator element 30 from the portions 511, the separator element 30 can continue to slide along the through-cavity 501 of the presser element 50, inserting in the interspaces (for example two thereof radially aligned) defined between the portions 511 (i.e. between the tabs 512) until the lower end 32 thereof (separated from the base 20) passes beyond and exits from the end of the tubular body 500 opposite the planar end 503.

Obviously simply by unscrewing the threaded shank 40 from the nut screw 51 it is possible to proceed in a different way.

In the example, the base 20, the separator element 30 and the threaded shank 40 are constituted by a monolithic body, for example made of a plastic material and for example obtained by (injection) moulding, the presser element 50 is constituted by a further monolithic body, for example made of a plastic material and for example obtained by (injection) moulding, and the collar 60 is constituted by a further monolithic body, for example made of a plastic material, and for example obtained by (injection) moulding.

The invention as it is conceived is susceptible to numerous modifications, all falling within the scope of the inventive concept.

Further, all the details can be replaced with other technically-equivalent elements.

In practice the materials used, as well as the contingent shapes and dimensions, can be any according to requirements, without forsaking the scope of protection of the following claims.

The invention claimed is:

1. A levelling spacer device (10) for laying slab-shaped products (P) for covering surfaces, the device (10) comprising:

- a base (20), positionable posteriorly of a laying surface of at least two slab-shaped products (P) adjacent and flanked with respect to a flanking direction (A);
- a separator element (30) which rises from the base (20) and is squared to the base, and is configured to contact, on opposite sides, lateral facing flanks of the two flanked slab-shaped products (P);
- a threaded shank (40) which rises from the separator element (30) with a screwing axis (B) thereof perpendicular to the base (20);
- a presser element (50) screwable to the threaded shank (40); and
- a collar (60) rotatably associated with respect to a rotation axis (E) coinciding with the screwing axis (B), to an end (503) of the presser element (50) facing towards the base (20), so that the collar (60) is axially interposed between the end (503) of the presser element (50) and the base (20), wherein a constraint (504, 62) is defined between the collar (60) and the presser element (50), said constraint (504, 62) is configured to axially constrain the collar (60) and the presser element (50).

2. The device (10) of claim 1, wherein the constraint comprises a snap-fit configured to axially removably constrain the collar (60) and the presser element (50), leaving free reciprocal rotation there-between with respect to the rotation axis (E).

3. The device (10) of claim 1, wherein the constraint comprises an annular step (504) coaxially associated to one from between the presser element (50) and the collar (60) and a plurality of engaging teeth (62) projecting axially from the other of the collar (60) and the presser element (50) and aligned along an imaginary circumference that is coaxial with respect thereto.

4. The device (10) of claim 1, wherein the collar (60) comprises a planar surface (601) perpendicular to the rotation axis (E) of the collar (60), interposed between the end (503) of the presser element (50) and the base (20) and facing towards the base (20).

5. The device (10) of claim 4, wherein the collar (60) comprises a slit (61), passing at the planar surface (601), configured so as to be passed through by the separator element (30) and to determine there-with a sliding coupling.

6. The device (10) of claim 5, wherein the slit (61) comprises a broadened central portion (610) coaxial with the rotation axis (E), the threaded shank (42) being insertable, with radial play, internally of the central portion (610).

7. The device of claim 1, wherein the slit (61) is elongate with a longitudinal axis that is radial with respect to the rotation axis (E) of the collar (60).

8. The device (10) of claim 5, wherein the collar (60) comprises two of the slits (61), squared to one another and joined at a common central portion (610).

9. The device (10) of claim 5, wherein the collar (60) comprises at least an orientating marker (63) projecting externally of the collar (60) in a direction that is aligned or squared to each slit (61).

* * * * *